US005123760A

United States Patent [19]

Tsuru et al.

[11] Patent Number: 5,123,760

[45] Date of Patent: Jun. 23, 1992

[54] PRINTER WITH VARIABLE RIBBON SHIFTING MECHANISM

[75] Inventors: Yoshio Tsuru, Kani; Yasunari Yoshida; Shin Nakagawa, both of Nagoya, all of Japan

[73] Assignee: Brother Kogyo Kabushiki Kaisha, Nagoya, Japan

[21] Appl. No.: 537,258

[22] Filed: Jun. 13, 1990

[30] Foreign Application Priority Data

Jun. 13, 1989 [JP] Japan ..... 1-150798
Oct. 23, 1989 [JP] Japan ..... 1-275676

[51] Int. Cl.[5] ..... B41J 35/20
[52] U.S. Cl. ..... 400/216.2; 400/216
[58] Field of Search ..... 400/216, 216.1, 216.2, 400/217

[56] References Cited

U.S. PATENT DOCUMENTS 3,782,521 1/1974 Hengelhaupt ..... 400/208
4,111,293 9/1978 Kockler et al. ..... 400/208
4,132,486 1/1979 Kwan ..... 400/213
4,606,661 8/1986 Aldrich ..... 400/212
4,611,938 9/1986 Rattke ..... 400/216
4,787,763 11/1988 Kinde ..... 400/212

FOREIGN PATENT DOCUMENTS 59-78882 5/1984 Japan ..... 400/216
1383101 2/1975 United Kingdom ..... 400/208

*Primary Examiner*—David A. Wiecking
*Assistant Examiner*—Steven S. Kelley
*Attorney, Agent, or Firm*—Oliff & Berridge

[57] ABSTRACT

A printer comprising printing head moving means, printing ribbon feeding means, ribbon printing position change means and printing control means, in which printing control means gives instruction signals to regulate the crosswise move of the ribbon or to change the number of shift instruction signals less at both the ends of the ribbon to make the usage frequency substantially uniform with the central region.

18 Claims, 12 Drawing Sheets

RIBBON SHIFT ROUTINE

PRESENT COLOR RED ?
S1
YES
NO
NEXT COLOR RED ?
S21
YES
NO
NEXT COLOR RED ?
S2
NO
YES
S14
C ← 0
S15
F ← -1
S16
n ≦ 5 ?
NO
YES
S18
n ← 11
S19
RIBBON SHIFT
S20
CARRIAGE MOVE
S17
n ← 21
S22
n ← 12
S3
n=0 ?
YES
NO
S10
n=14 ?
NO
YES
S12
F ← -1
S4
F ← 1
S5
C ← C+1
S6
C=4 ?
NO
YES
S7
C ← 0
S11
n ← n+F
S8
n ← n+F*2
S9
RIBBON SHIFT
END

PRINTER WITH VARIABLE RIBBON SHIFTING MECHANISM

BACKGROUND OF THE INVENTION

The present invention relates to a printer equipped with a mechanism for shifting across a printing head a printing ribbon that is broader than the printing head.

This kind of a printer is known as disclosed, for example, in Japan Published Unexamined Patent Application No. 59-78882. Conventional printers of dot impact type are constructed so as to feed a printing ribbon broader than a printing head in a direction of printing lines and to shift the ribbon by a stepping motor or the like in a direction of ribbon width orthogonal to printing lines.

Such shifting will be explained with reference to FIG. 7. A printing ribbon 200 is fed in a direction shown by an arrow a, and, after one line is printed, the ribbon 200 is shifted in a direction of its width b or c by the amount of shift corresponding to a fixed number of pulses giving to a stepping motor in a shape of steps (n represents positions of steps). Oblong printing faces 201 which can be printed in case of impacting all printing wires of a printing head are shifted reciprocally within the area of 12 steps in a direction of the ribbon width. In this way, the printing ribbon 200 can be efficiently consumed. By shifting an amount of three steps, the ribbon 200 is shifted the longitudinal width of the printing face 201.

The printer described in the above, however, has the following problems.

The printing areas A, B through O are different in frequency of use by the printing head during one cycle of reciprocation of the printing face 201 on the ribbon 200. In other words, the area A or O is used once, the area B or N thrice, the area C or M five times and the areas D through L are used six times per one cycle. For this reason, the printing faces 201 strike more in the central region of the ribbon 200, while striking less in the top and bottom regions of the ribbon 200. The areas A, B, N and O where usage frequency is less than 3 times occupy 4/15 or 26.6% of the effective usage area of the ribbon in the direction of width.

Accordingly, when the ribbon 200 is used repeatedly, the central region is used more than the top or bottom region. As a result, printing effects are dark and thick in the top and bottom regions while light and thin in the central region.

In the top and bottom regions of the ribbon, which are not used frequently, the ink remaining nearby blots at the position where the ribbon is impacted by the printing wire, resulting in different shade of the ink of one character printed.

SUMMARY OF THE INVENTION

This invention is made to solve the above problems and for improvement of the usage efficiency of the ribbon as well as maintenance of high quality printing.

In order to accomplish the above objects, the printer of the invention comprises;

- a printing head moving means M1 which moves a printing head H to print according to input data along printing lines of a printing sheet P:
- a printing ribbon shifting means M2 which shifts a ribbon R extending in a direction of printing lines between the head H and the sheet P in correspondence to instruction signals inputted and in a direction of the ribbon R having a broader width than the printing width of the printing head N in a direction of its height:
- a ribbon feeding means M3 which feeds the ribbon R in a direction of printing lines; and
- a control means M4 which outputs specified number of shift instruction signals to the ribbon shifting means after the movement of the printing head H by the head moving means M1, wherein the printer is provided with a shift amount change means M5 which changes smaller the number of shift instruction signals outputted at one time shift of the ribbon R when the printing position is within the specified region from the end portion of the ribbon R than the number when it is in the central region outside of the above end portion.

DETAILED DESCRIPTION OF PREFERRED EMBODIMENTS

One embodiment of the invention will now be described in detail with reference to drawings.

Figure 1:
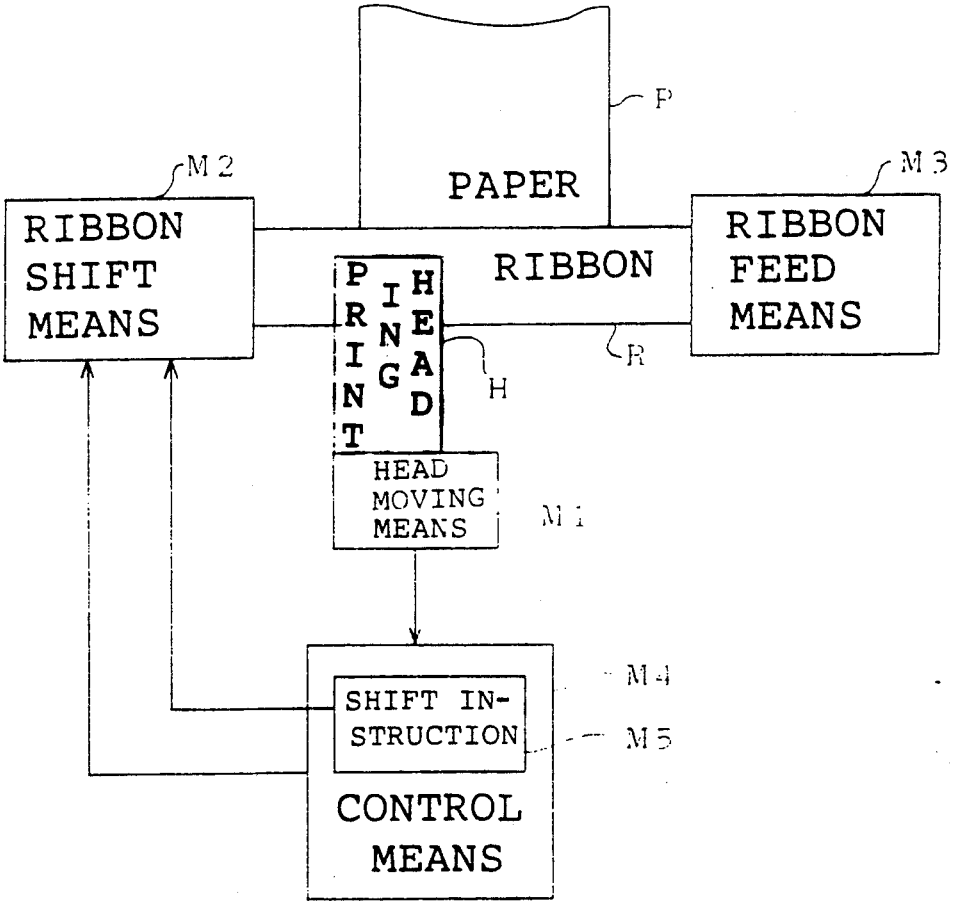
FIG. 1 is a schematic block diagram of the invention.
Figure 2:
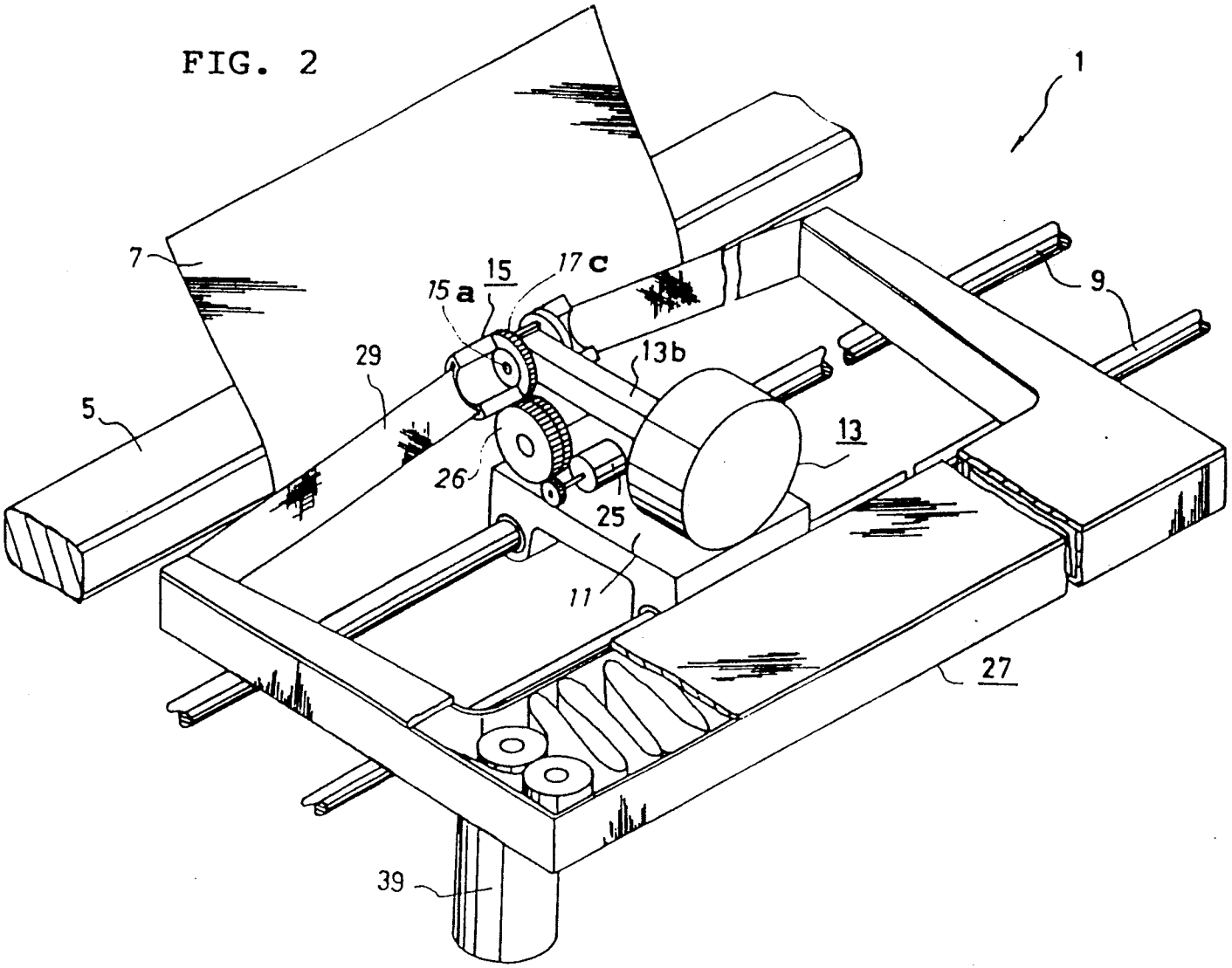
FIG. 2 is a perspective view of a dot type printer of a first embodiment.
Figure 4:
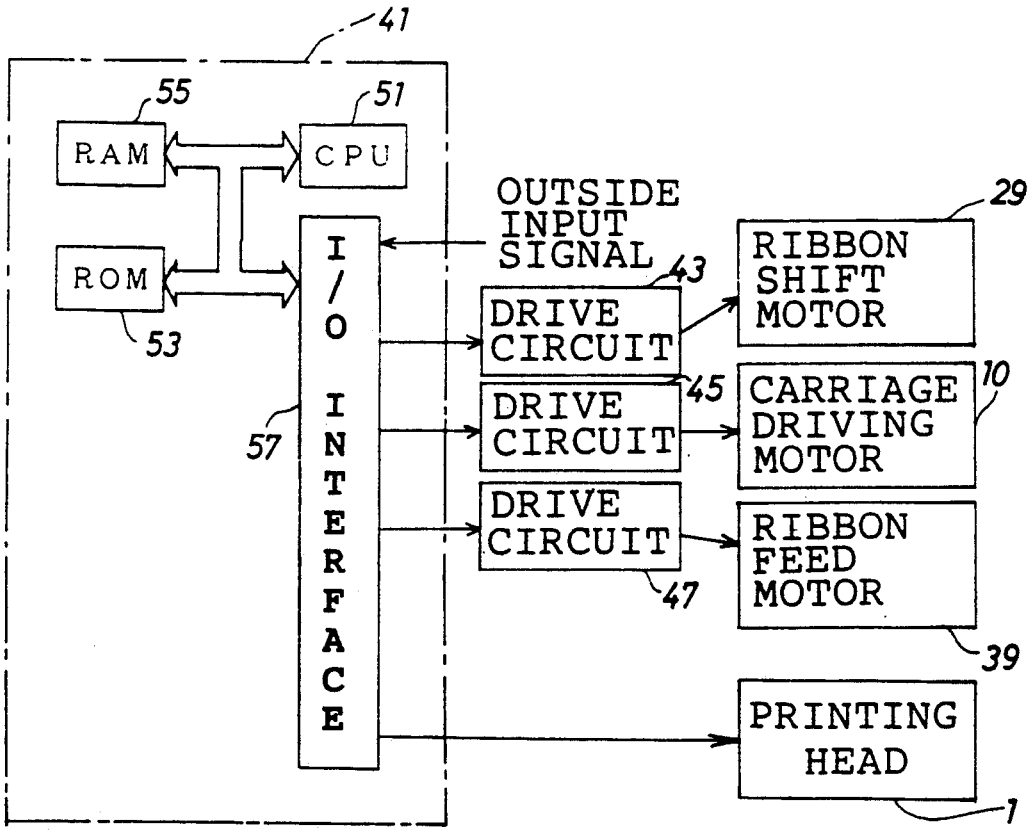
FIG. 4 is a block diagram showing an electronic control devices and its periphery.

In FIG. 2, a plate-like platen 5 is provided between a pair of frames (not shown) in a dot printer and a sheet of printing paper 7 is inserted to the platen. The printing paper 7 is fed in a fixed direction being driven by a paper feeding roller (not shown). Between these frames, a pair of carriage guides 9 are provided parallel to the platen 5. A carriage 11 is slidably supported in an axial direction of the carriage guides 9 thereon. To the carriage 11, a carriage driving motor 10 such as a stepping motor, a DC motor and others are connected, as shown in FIG. 4, via a timing belt (not shown) so that the carriage 11 may reciprocate parallel to the printing line being driven by the carriage driving motors 10.

A printing head 13 of dot impact type is provided on the carriage 11, which selectively drives a number of electromagnetic devices (not shown) contained therein according to the printing data and actuates printing wires (not shown) corresponding to such devices, thus printing the printing data in a type of dot matrix.

Figure 3:
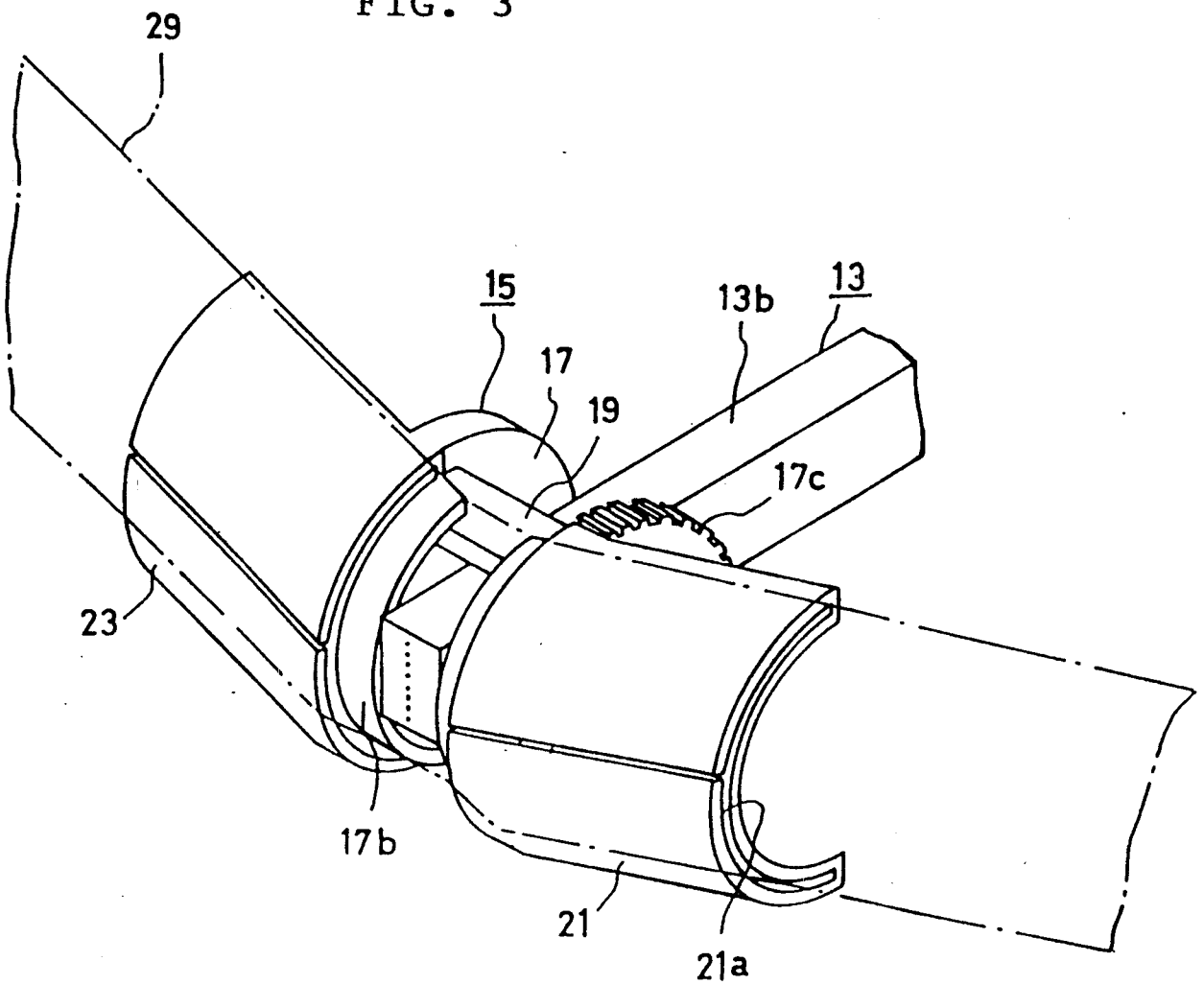
FIG. 3 is a perspective view of a ribbon guide.

At the end portion of a nose **13*b* of the head 13, a ribbon guide 15 as a guide member is supported centering around a shaft 15*a* to move vertically crossing the printing lines. A broad printing ribbon 29 of black and red colors is supported in the ribbon guide 15 so as to run along the printing line. As shown in FIG. 3, the ribbon guide 15 is unitally formed of synthetic resin with a pair of guide bodies 17 shaped like a disk and a stopper 19 connecting these guide bodies 17 as well as regulating the movement of the ribbon guide 15 in a vertical direction by abutting the nose portion 13***b* of the head 13. On the rear end surface of surface 17*b* is formed substantially corresponding to the printing end surface of the head 13. On both the rear end side surfaces of the guide body 17, ribbon guide members 21, 23 having guide passages 21*a* are unitally formed somewhat inclining ahead at the side of the printing head and extending in the printing line direction. Further, a gear 17*c* is provided at the front end side of the guide body 17, to which a ribbon shift motor 25 such as the stepping motor or others provided on the carriage 11 are connected via an idling gear 26. Being driven by the ribbon shift motor 25, the ribbon guide 15 swings vertically crossing the printing line and centering around the axis 15*a* via the gear 17*c*. Thus, the printing ribbon 29 inserted into the guide passage 21*a* is shifted.

The ribbon 29 is formed in a shape of an endless loop and is contained in a ribbon cassette 27 interchangeably attached to the frame, the ribbon being folded in a direction of the width crossing the printing line. The ribbon is sent out by a ribbon feeding motor 39.

Driving control of the printer is executed by an electronic control device 41 as shown in FIG. 4. The electronic control device 41 takes in outside input signals such as detection signals of each sensor, output signals of each switch and others, which drive the carriage driving motor 10, the ribbon feeding motor 39 and the ribbon shift motor 29 via each driving circuit 43, 45 or 47 and send printing signals to the printing head 13 to execute printing. The electronic control devices 41 comprise known CPU 51, ROM 53, RAM 55, Input/Output interface 57. ROM 53 stores programs and data to execute processing as shown in flowcharts of FIG. 6, FIG. 7, and FIGS. 10A and 10B.

Before explaining the ribbon shift process shown in a flowchart of FIG. 6, the general concept of this invention will be described with reference to FIG. 5.

Figure 5:
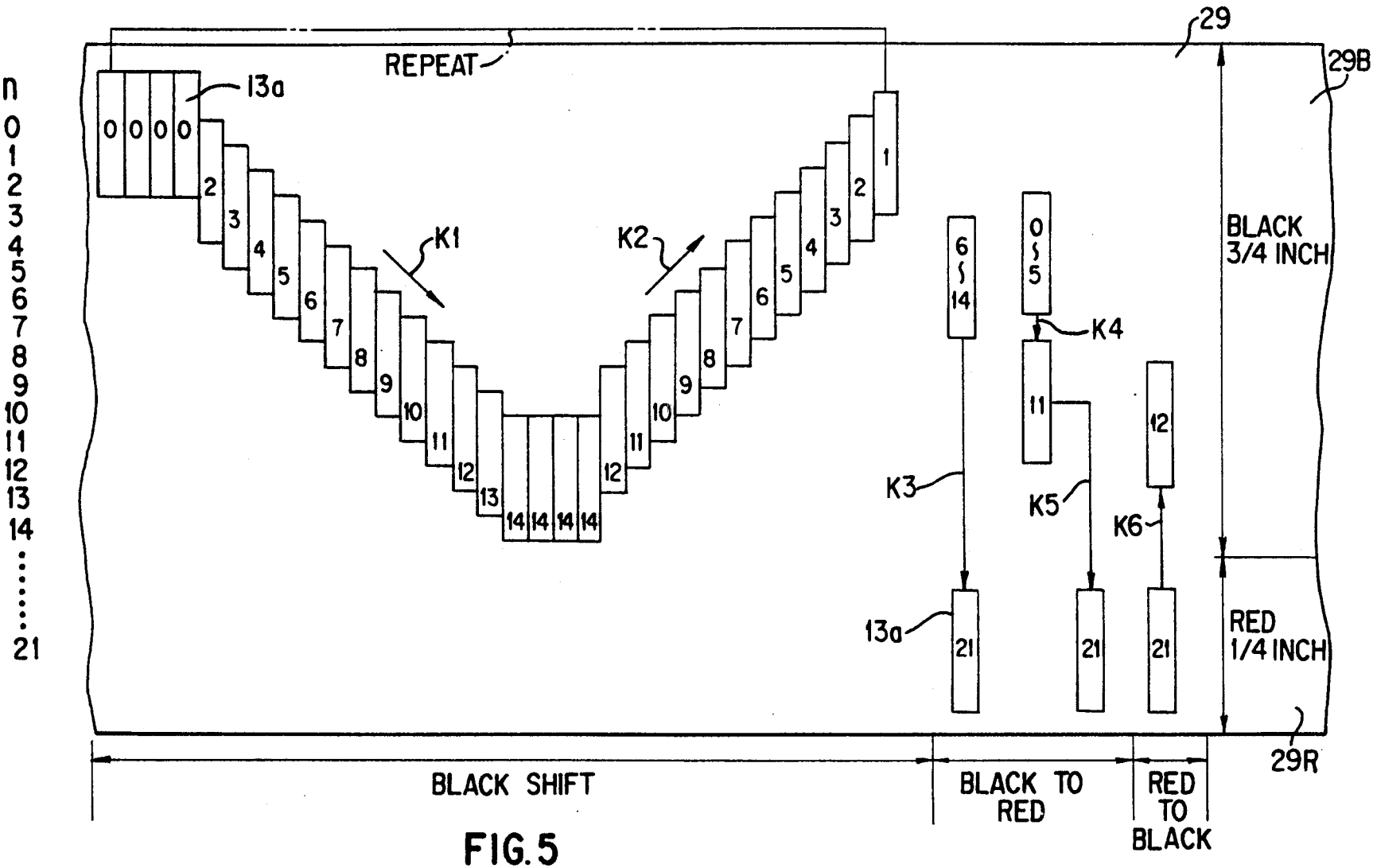
FIG. 5 is an explanation of operations of the first embodiment.
Figure 6:
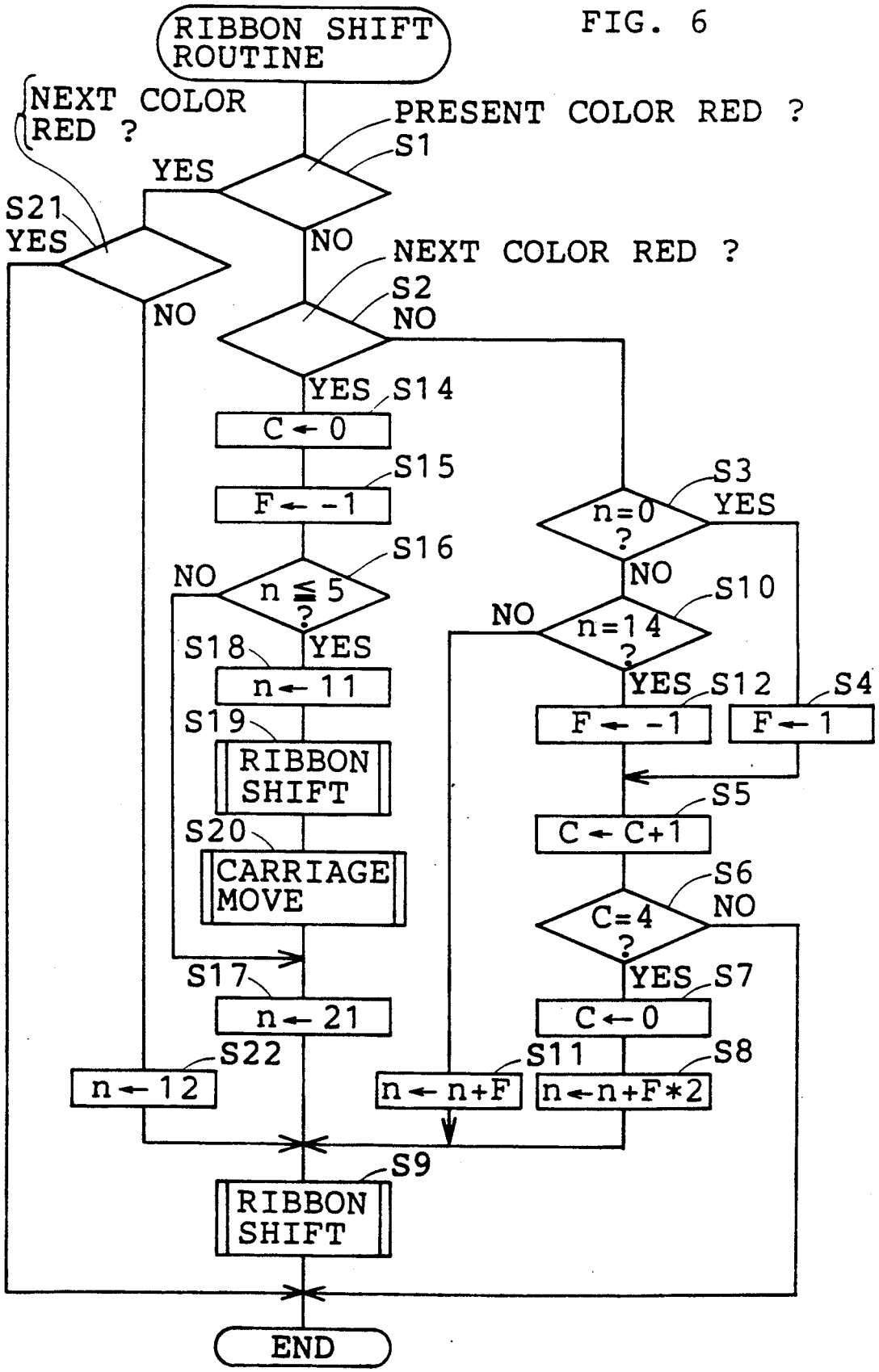
FIG. 6 is a flowchart of the embodiment.
Figure 7:
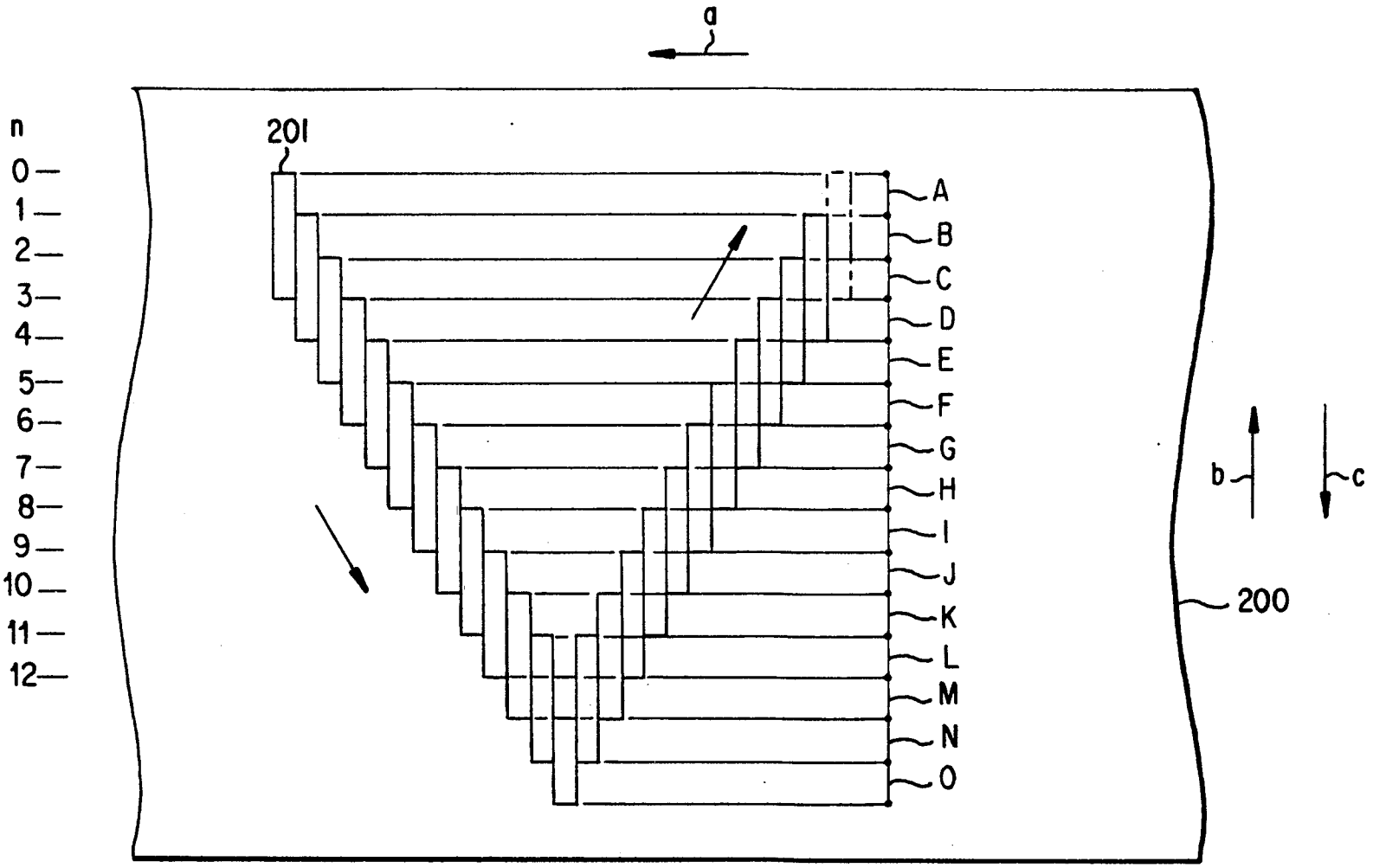
FIG. 7 PRIOR ART
FIG. 7 is an explanatory chart of prior art.

FIG. 5 illustrates a printing ribbon 29 one inch wide, ¾ inches of which are black zone 29B and ¼ inches of which are red zone 29R. The ribbon 29 is moved against the printing face 13*a* of the printing head 13 by pulse signals of 21 steps of the ribbon feeding motor 39. The positions of 21 steps are represented by n ( 0, 1, 2, . . . 21 ). The step positions 0 through 14 are used for the black zone 29B and only the bottom step position 21 is used for the red zone 29R.

When the printer is actuated, the printing face 13*a*starts from the step position n=0 of the printing ribbon 29 for printing in black. First, at step position n=0, four printing lines are maintained. Then, it moves to step position n=2. After that, it moves downwards sequentially by one step for printing one line each. When it reaches step position n=14, it is maintained at that position four times for printing. According to this routine K1, the ribbon is shifted from the uppermost to the bottom of the black zone 29B. On the other hand, the routine K2 of shifting from step position n=14 to step position n=0 is that it moves to step position n=12 and then moves upwards sequentially one step each, reaching step position n=0. This reciprocating move is repeated.

When changing printing from black to red or vice versa, the ribbon is shifted in one motion K3 to step position n=21 of the red zone 29R, if the printing face 13*a* is within step positions n=6 through 14 of the black zone 29B. If it is within step positions n=0 through 5, the ribbon is shifted to step position n=21 in two motions K4 and K5.

When shifting the ribbon from red to black, the process moves to step position n=14 of the black zone 29B, when the ribbon is shifted from step position n=21 of the red zone 29R by seven steps upwards. Furthermore, it moves to step position n=12 shifting in nine steps upward motion K6.

Such ribbon shift routine is explained with reference to a flowchart of FIG. 6. In the following description, S represents a step of the routine, and the routine is based on the processes of K1 through K6 in FIG. 5.

First, whether the current printing color is red or black is determined at S1. If the current printing color is black, the routine moves to S2, which determines whether the next printing color is red or black. If the next color is black, the routine moves to S3. In other words, when printing is continuously black, the routine moves from S1 to S2 to S3. S3 determines whether or not the printing face 13*a* is at step position n=0 of the ribbon 29. When the printing face 13*a* is at step position n=0, the routine moves to S4, where flag F is set to 1. The flag F shows whether the ribbon 29 is controlled to shift downwards K1 (F=1) against the printing face 13*a* from the uppermost or to shift upwards K2 (F=−1). In this case, since step position n is 0 and the shift direction is only downwards, flag F is set to 1. At S5, a counter C counts up, and at S6, whether or not the counter C is 4 is determined. In the first process steps, since the counter C is 0, a negative determination is made at S6 and the process steps end. In another routine, one line of printing is executed.

Next, at S1 through S6, the counter C counts up while executing 4 lines of printing. When the counter C reaches 4, an affirmative determination is made at S6 and the process steps move to S7. At S7, the counter C is reset, and at S8, the value of n is increased by F*2, or 2 since F is 1. At S9, the ribbon 29 is shifted to step position n=2 set at S8. Thus, this routine ends and one line of printing is executed at this position.

Next, a negative determination is made at S3 since n is 2, and the process moves to S10, which determines whether or not the step position n is 14; specifically, S10 determines whether the printing face 13*a* is at the bottom position of the black zone 29B. Since n is 2, the process steps go to S11, where n is increased by the number of F or 1. At S9, the printing ribbon 29 is shifted according to the value of n and this routine ends. Accordingly, by the repetition of S1 to S2, S3, S10 and S11, the printing face 13*a* is shifted one step each to step position n=14. When it is determined at S10 that n reaches 14, or the ribbon 29 reaches the bottom of the black zone 29B, the process steps go to S12 and sets flag F to −1. Next, at S1 through S6, the printing face 13*a* is maintained at step position n=14 by 4 printing lines and thereafter, at S7 through 9, the ribbon 29 is shifted to step position n=12. By the repetition of S3 to S10, to S11, the printing face 13*a* is shifted in one step increments from step position n=12 to step position n=0.

The change of printing color from black to red or from red to black is executed by the processes of S1, S2, S14 through S22. In other words, when S2 gives an instruction to change color from black to red, the process steps go to S14, resets the counter C, and, at S15, sets the flag F to −1. Setting of this flag F is a preliminary preparation for changing the shift direction to K2, when the next-time ribbon shift from red to black is executed. At S16, it is determined whether n is less than 5 or not, namely, whether step position n is within 0 through 5 or within 6 through 14. When it is determined to be within 6 through 14 at S16, the process steps go to S17, set n to 21 and shift the ribbon to step position n=21 at S9 (K3).

When it is determined at S16 that step position n is within 0 through 5, n is set to 11 at S18 and ribbon shift is executed at S19 (K4). At S20, a signal is output to the carriage drive motor 10 to move the carriage 11 by around 100 mm. At S17, n is set to 21, and at S9 the ribbon is shifted to step position n=21.

When the printing color is red in succession, S1 to S21 is repeated. At S21, when printing is changed from red to black, n is set to 12 at S22 and the ribbon is shifted at S9. In other words, the ribbon is shifted by nine pulses upwards from step position n=21 within the red zone 29R to step position n=12 within the black zone 29B.

In this embodiment, the printing face 13*a* is maintained four times at the both end portions n=0 and 14 of the black zone 29B of the ribbon 29, therefore the ribbon 29 being used at almost the same frequency as the intermediate portion where n=1 through 13. The printing duty ratio showing the usage frequency in the width direction of the ribbon 29 is 74 percent at the minimum and 119 percent at the maximum. Compared with the prior art, the usage frequency of the ribbon 29 becomes uniform. The non-uniformity of printing shade owing to different positions of the printing face 13*a* becomes imperceptible, thus improving the printing quality.

When shifting the ribbon from black to red, if the distance is short, as when n=6 through 14, the shift is executed in one move. However, if the shift distance is long, as when n=0 through 5, the shift is executed in two moves. Since the ribbon is not shifted a long distance, it prevents the ribbon 29 from creasing. When shifting the ribbon extending over the black and red zones, the number of steps is different according to the shifting direction. Because the red zone 29R is narrow compared with the black zone 29B, when shifting from the narrow zone to the wide zone, the tensile force is large in the vicinity of the central portion. To secure shifting in opposition to this force, when shifting from red to black, more steps are taken. Namely, if going back from step position n=21 to step position n=14, it can be shifted to black, however, two steps are added, going back to step position n=12. Conventionally, the black zone 29B is to be used theoretically by the width of 14 steps but only 12 steps have been used to prevent the colors from mixing. By so differentiating the shift amount, the usage is expanded to 14 steps, thus the ribbon is effectively used.

In this embodiment, the ribbon is one inch wide, ¾ inches of which is for black and the rest is for red. Also when a one-inch black ribbon is used, the same effect as in the embodiment can be obtained. Also a 7 pin printer or 1/72 pin pitch for a one-inch ribbon may be used, but a different number of pins or a ribbon of different width can be used in the same way as in the first embodiment.

Next, a second embodiment of this invention will be described below with reference to the drawings.

Figure 9:
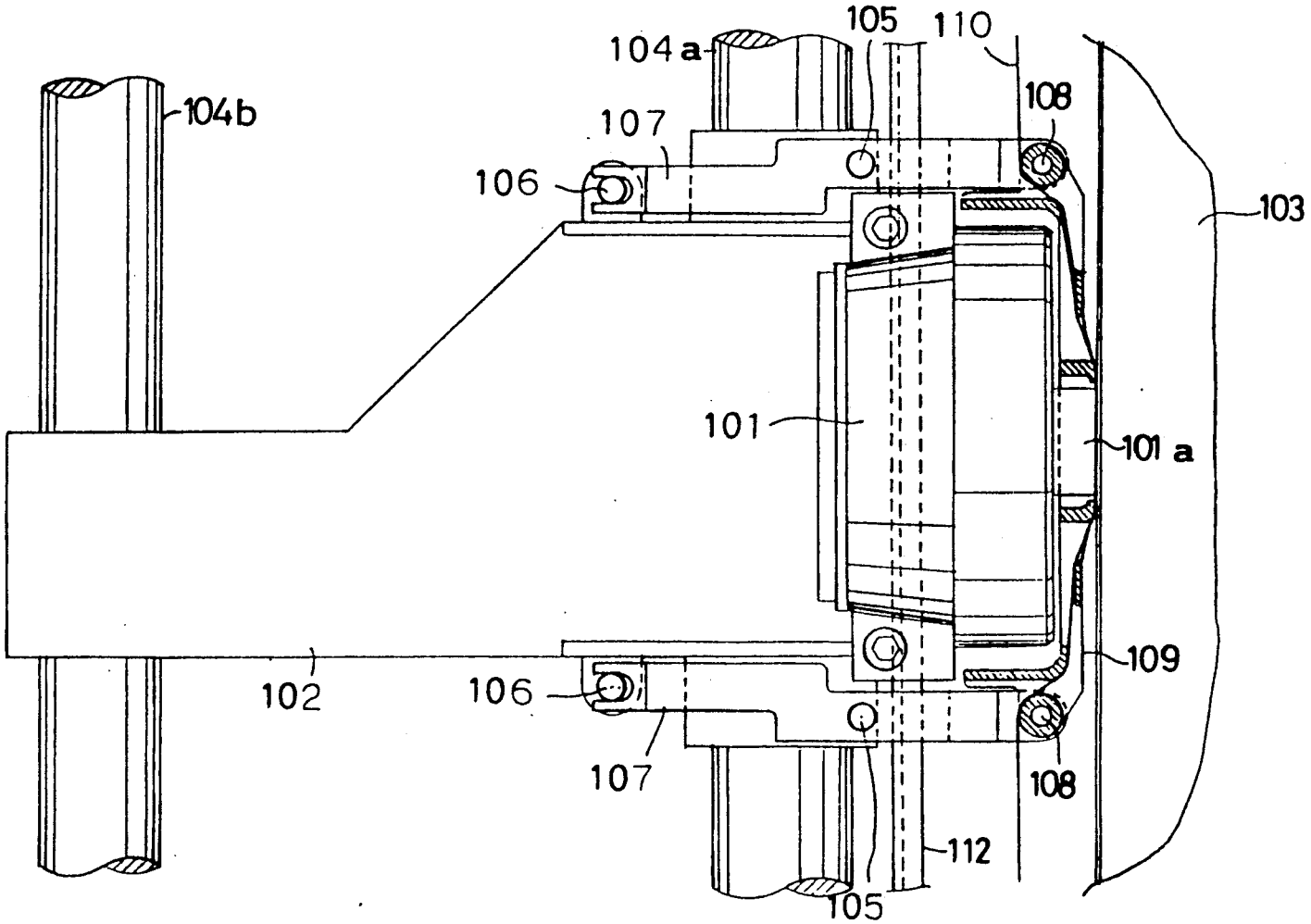
FIG. 9 is a plan view of the essential parts.

As shown in FIG. 9, a carriage 102 having a printing head 101 at the front is supported movably in a lateral direction along a pair of front and rear guide shafts 104*a*, 104*b* disposed parallel to a platen 103 between a pair of right and left frames (not shown). A pair of front and rear guide pins 105, 106 are erected respectively on both sides of the front of the carriage 102, to which a ribbon guide 107 is inserted slidably upwards and downwards.

Further, a ribbon holder 109 is inserted into two guide pins 108 erected on both sides of the front end of the ribbon guide 107, by which a printing ribbon 110 one inch wide or broader than the width of a nose portion 101*a* of the printing head 101 in a direction of its height is guided and supported on the ribbon holder 109 to run in the front of the nose portion 101*a*.

Figure 8:
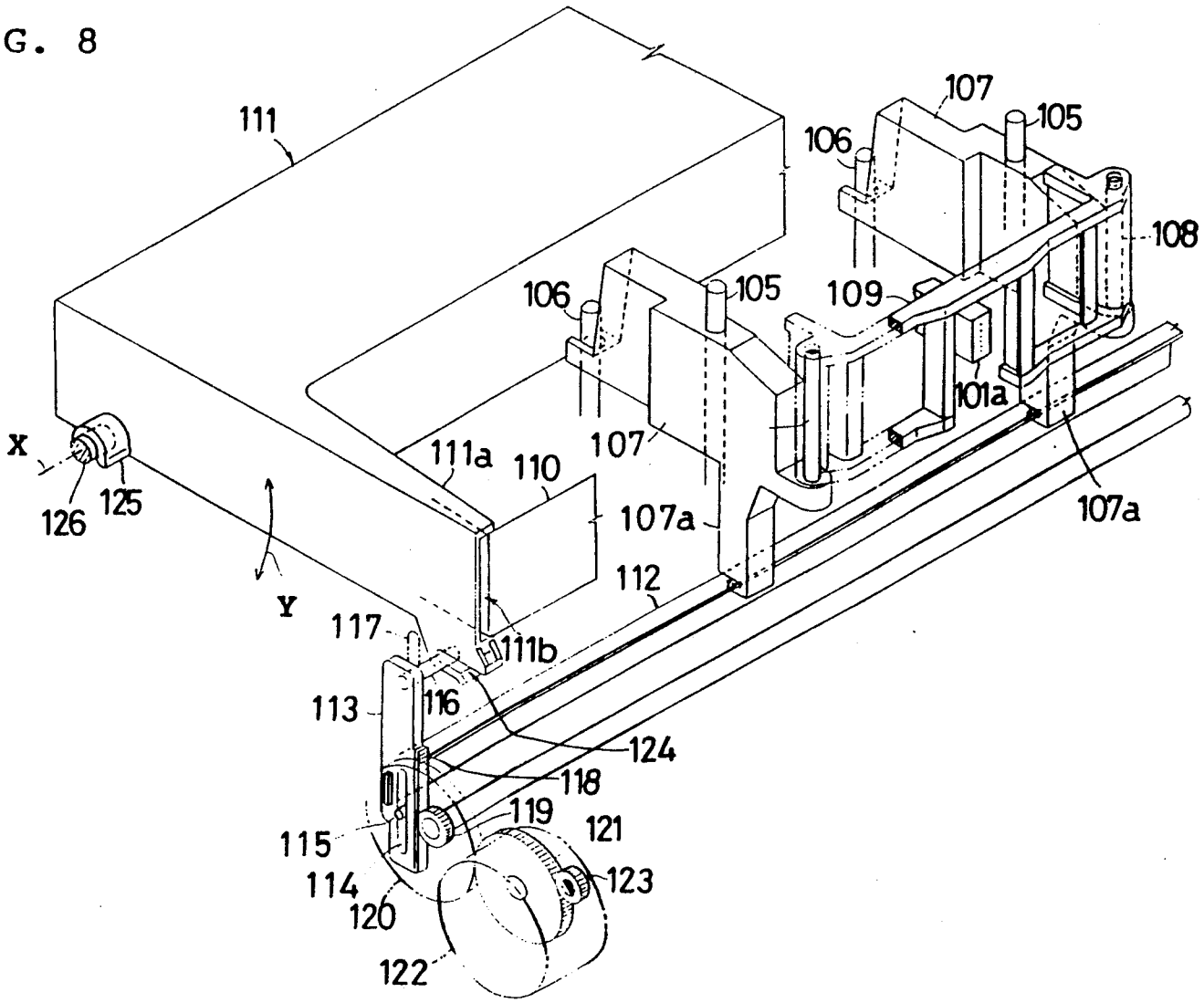
FIG. 8 is a perspective view illustrating essential parts of a printer of a second embodiment.

As shown in FIG. 8, the ribbon 110 is shaped like an endless belt, which is accommodated in a cassette so that a part thereof is exposed outside between front openings 111*b* of ribbon guide arms 111*a* extending out to the front from the both sides of the ribbon cassette 111.

From the ribbon guide 107, a pair of legs 107*a* on both sides extend out and downwards, the lower ends of which are engaged and supported slidably in a lateral direction by the guide rails 112 extending along guide shafts 104*a*, 104*b*. On both ends of the guide rails 112, racks 113 are fixed and slots 114 are formed thereon. The guide pins 115 fixed on the frame are engaged with the slots. Further, engagement pins 116 provided on the upper ends of each rack 113 are supported going through the slots 117 formed on the printer frame, thus enabling the both racks 113 to move only in a vertical direction.

The engagement pins 116 provided on the upper ends of each rack 113 are engaged with a recess 124 formed in the front end lower portion of the ribbon cassette 111. The engagement portion 125 formed at the rear portion of the ribbon cassette 111 is engaged and supported from the above by a horizontal fulcrum pin 126 fixed on the frame so as to be detachable and swingable. Gears 118 of the right and left racks 113 are engaged for interlocking with output gears 123 of ribbon shift motors 122 such as a stepping motor and others via pinion gears 119 and gears 120, 121 engaged therewith. In accordance with the reciprocal rotation of the ribbon shift motor 122, the racks 113 on both sides move vertically, then the guide rail 112 moves vertically and the ribbon guide 107 shifts against the nose portion 101*a* of the printing head 101 provided on the carriage 102. Simultaneously, the ribbon cassette 111 swings with a shaft center x of the fulcrum pin 126 as a center in a direction of y shown in the figure. Thus, the ribbon 110 is shifted in a vertical direction against the nose portion 101*a* of the printing head 101*a* of the printing head 101 or in a cross direction of the ribbon.

The ribbon 110 is forwarded by a known ribbon feed motor 39 in a direction of the printing line. When power is put on, a ribbon shift motor 29 is actuated and the upper end portion of the ribbon 110 is compulsorily set at an initial position opposing to the nose portion 101*a*. The driving control of the printer is executed by the electronic control device 41 shown in FIG. 4.

When a two-pulse drive signal is input, a driving circuit 43 of the ribbon shift motor 29 shifts across the ribbon 110 by one unit amount or an amount of one step via the ribbon shift motor 29. By the shift of an amount of 14 steps, the ribbon 110 is shifted by the height of the characters which can be printed by all the printing wires. In other words, the shift of 14 step amount in the printer of this embodiment corresponds to the 3 step amount of the prior art shown in FIG. 7.

A ribbon feed motor 39 is driven via a driving circuit 47 while a carriage drive motor 10 is driven.

Figure 10A:
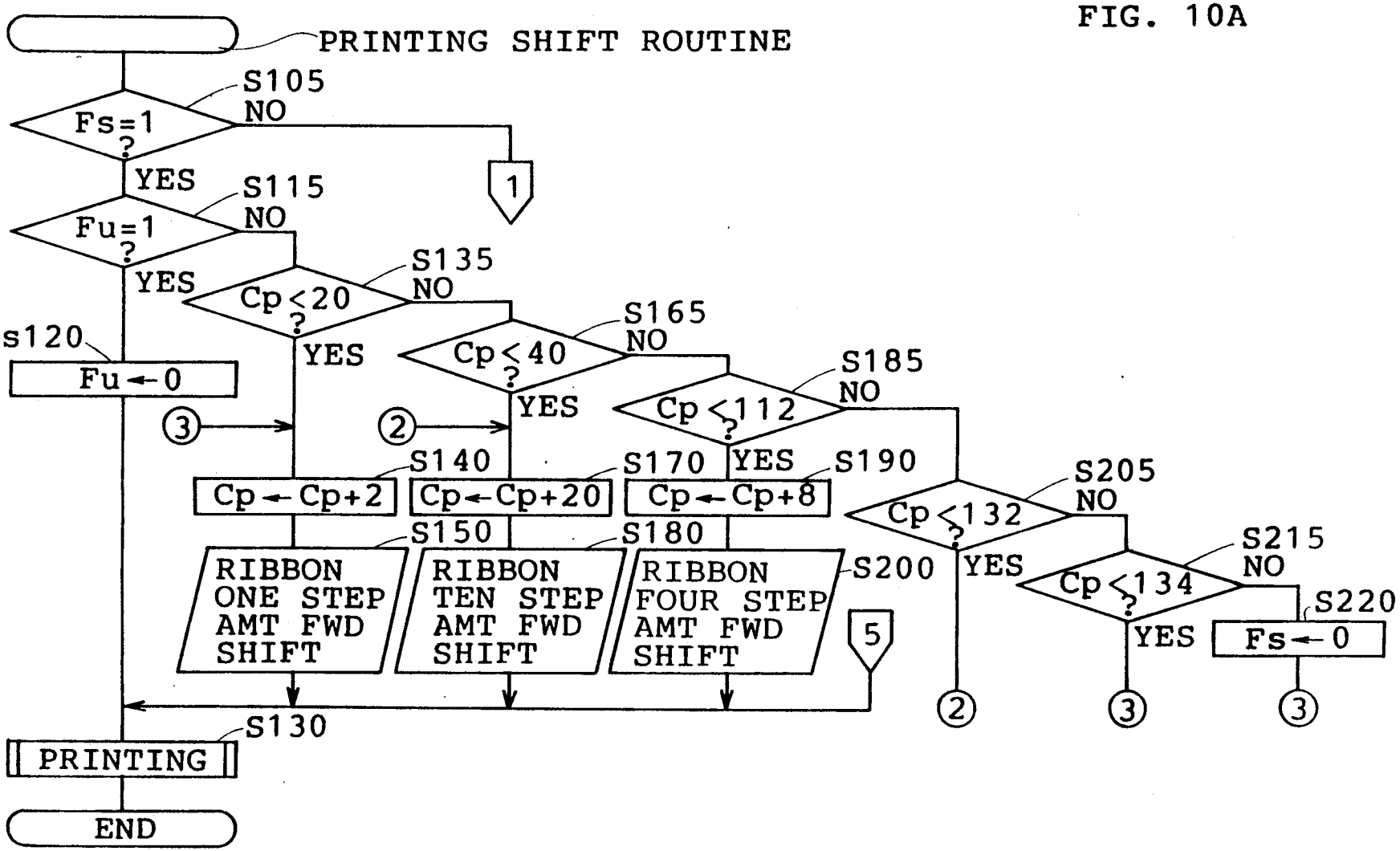
FIGS. 10A and B are flowcharts of printing shift routines.
Figure 10B:
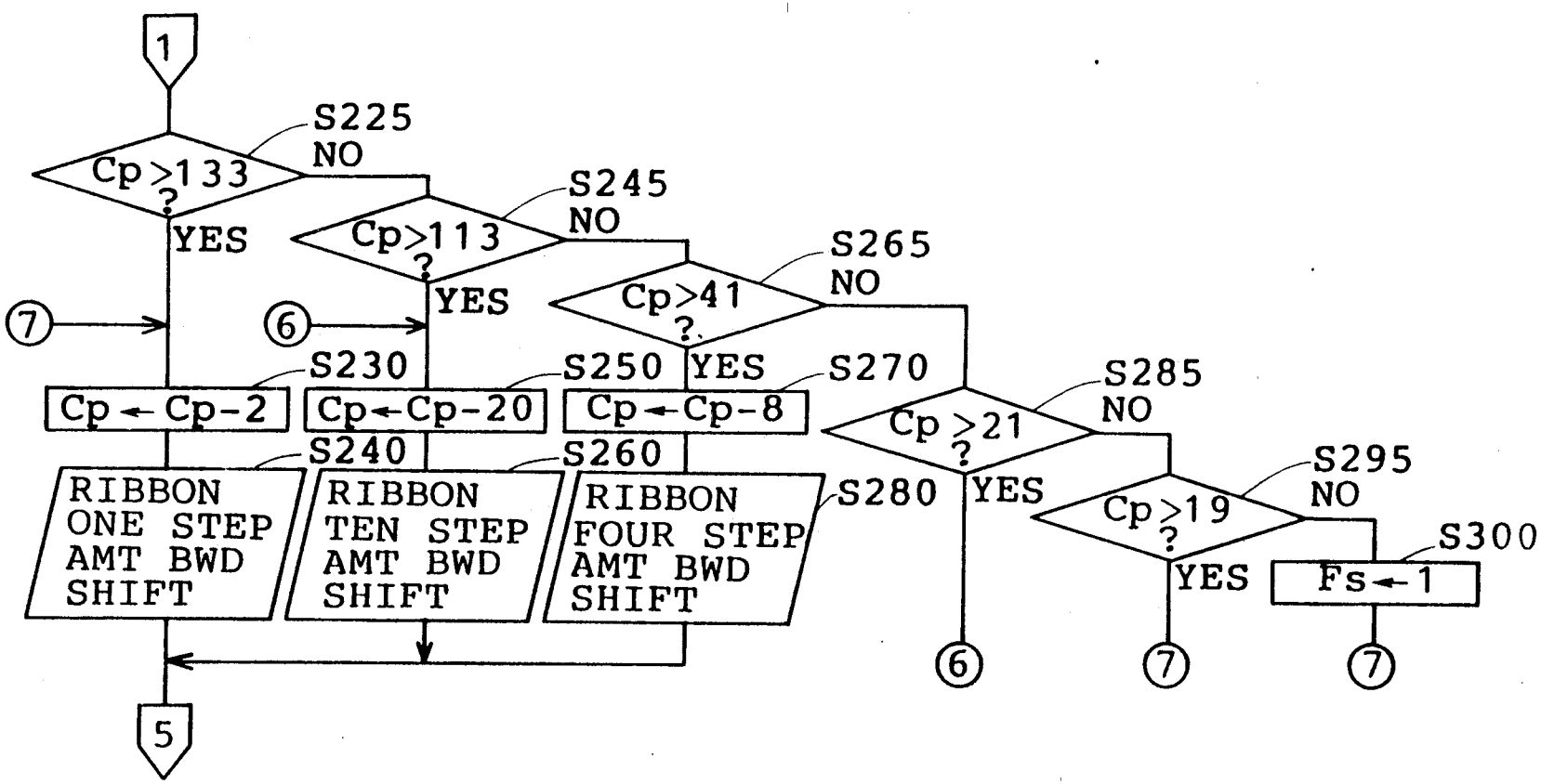

Next, the printing shift routine executed in this electronic control devices 41 is explained according to the flowcharts of FIGS. 10A and 10B.

The printing shift routine as shown in FIGS. 10A and 10B is repeated each time when printing instruction signals are input. Through the initial processing, such as clearing of the internal register at the actuation of the electronic control devices 41, setting of initial value 16 at a position counter CP described later, setting of initial value 1 for the shift direction change flag FS and a ribbon upper end turn-down flag FU and others , this routine is executed.

First, S105 determines from the setting status of the shift direction change flag FS whether or not the direction of the ribbon shift is forward, namely, the direction in which the ribbon 110 is shifted upwards and the printing position of the nose portion 101*a* descends relative to the ribbon width direction or the reverse direction in which the ribbon 110 is shifted downwards and the printing position ascends relative to the ribbon width direction.

This shift direction change flag FS is set to 1 when the printing position reaches the upper end turn-down position. When FS is 1, subsequent ribbon shift direction is forward.

When it is determined FS is 1 at S105, the process moves to S115 and after the subsequent processes for shifting the ribbon 110 forwards. When FS is 0, the process moves to S225 and the subsequent processes for shifting backwards. After it is determined FS is 1 at S105, the setting status of a ribbon upper end turn-down flag FU determines whether or not the printing position is the upper end turn-down position of the ribbon at S115.

When it is determined that FU is 1 at S115, the ribbon upper end turn-down flag FU is set to 0 at S120, the printing head 101 and the carriage 102 are driven according to the printing data to print one line at S130, thus ending this process steps. In other words, the first printing after power being put on is to execute the processes of S105, S115, S120 and S130 since FS is 1 and FU is 1 in the initial process as described in the above. Ribbon shift of the ribbon 110 is not executed. At the ribbon upper end turn-down position, one-line printing is necessarily executed.

When the next printing instruction signal is input, it is determined FU is 0 at S115. It is determined at S135 whether or not the position counter CP is within less than 20. Whether or not the printing position is situated at the upper end portion within the specified region from the ribbon upper end turn-down position is determined by the CP value in order to shift the ribbon 110 forward.

When one line printing is executed at the ribbon upper end turn-down position, it is determined affirmative at S135 since CP is 16 at the initial process described above. The position counter CP is increased by 2 at S140. Then, a 2-pulse drive signal is outputted to the drive circuit 43 to drive a ribbon shift motor 29 and to shift the ribbon 110 forward by one step amount at S150. Next, one line printing is executed at S130.

Starting from CP being 16 and repeating twice each process step S140, S150, S130, the CP becomes 20. Accordingly, a negative determination is made at S135 and the process steps move to S165, where it is determined whether or not the printing position is situated in an upper region adjacent to the upper end portion at the central side of the ribbon according to whether or not the value set at the position counter CP is less than 40.

Since the CP is 20 in this case, it is determined affirmative at S165 and the CP is increased by the value of 20 at S170, a twenty pulse drive signal is outputted to the drive circuit 43 and the ribbon 110 is shifted forward by the amount of ten steps at S180. Then, the process moves to S130, where one line printing is executed.

Next, as the CP becomes 40, a negative determination is made at S165 and the process steps move to S185, where it is determined whether or not the printing position is situated in the central region of the ribbon, according to whether or not the value set at the position counter CP is less than 112.

Since the CP is 40 in this case, an affirmative determination is made at S185, the position counter CP is increased by the value of 8 at S190, and an eight pulse drive signal is outputted to the drive circuit 43 to shift the ribbon 110 forward by an amount of four steps at S200. Then, the process steps move to S130, where one line printing is executed.

Starting from the status where the CP is 40 and repeating the process steps S190, S200, S130 nine times, the CP becomes 112 and it is determined negative at S185. The process steps go to S205, where it is determined whether the printing position is situated in a lower region adjacent to the lower end portion within the specified range from the lower end turn-up position of the ribbon according to whether or not the value set at the position counter CP is less than 132.

Since the CP is 112 in this case, an affirmative determination is made at S205 and the process steps move to S170, where the value of the position counter CP is increased by 20. Then, the ribbon 110 is shifted forward by an amount of ten steps at S180. Next, at S130, one line printing is executed.

When the CP becomes 132, a negative determination is made at S205 and the process steps move to S215, where it is determined whether or not the printing position is situated at the lower end portion according to whether or not the value set at the position counter CP is less than 134.

As the CP is 132, an affirmative determination is made at S215 and the process steps go to S140, where the value of the position counter CP is increased by 2 and, thereafter, S150 and S130 are executed. In other words, the forward shift of the printing ribbon 110 by an amount of one step and one line printing are sequentially executed.

Next, the CP becomes 134 and a negative determination is made at S215. Then, the value of the shift direction change flag FS is set to 0 at S220 to change the following ribbon shift direction to backward. The process steps go to S140, the value of CP is increased by 2, the ribbon 110 is shifted forward by one step amount, and one line printing is executed with the printing position at the turn-up position of the bottom end of the ribbon at S130.

Since the shift direction change flag FS is 0 after the printing position reaches the turn-up position of the bottom end of the ribbon, a negative determination is made at S105 and the process steps after S225 are executed.

Regarding the process steps after S225, the shift step amount against the printing position, execution of printing and others are the same as the case of forward shift except tee direction of the ribbon shift being backward or the direction which the printing position ascends crosswise of the ribbon. Accordingly, the following explanation is made omitting the same portions.

After finishing the printing at the turn-up position of the bottom end of the ribbon, the CP is 136. An affirmative determination is made at S225, the value of the CP is decreased by 2 at S230, the ribbon 110 is shifted backward by one step amount at S240, and then S130 is executed to print one line.

Thus, repeating twice the process steps S230 through S240 starting from CP being 136, CP becomes 132 and the process steps go to S245, where it is determined whether or not the printing position is situated in the lower adjacent region.

Since the CP is 132 in this case, an affirmative determination is made at S245 and the CP is decreased by 20 at S250. The printing ribbon 110 is shifted backward by an amount of ten steps at S260 and the process steps move to S130. Next, since CP is 112, the process steps move to S265, where it is determined whether the printing position is situated in the central region of the ribbon.

As the CP is 112, an affirmative determination is made at S265, the CP is decreased by 8 at S270, the ribbon 110 is shifted backward by an amount of four steps at S280, then the process steps go to S130.

Repeating 9 times the process steps S270, S280 from when the CP is 112, the CP becomes 40. The process steps go to S285, where it is determined whether or not the printing position is situated at the upper adjacent region.

As the CP is 40, an affirmative determination is made at S285 and the process steps go to S250, where the CP is decreased by 20 and the ribbon 110 is shifted backward by an amount of ten steps, then one line printing is executed at S130.

Thus, the CP is 20 and a negative determination is made at S285, the process steps move to S295, where it is determined whether the printing position is situated at the upper end region. An affirmative determination is made at S295 since the CP is 20, The process steps S230, S240 and S130 are executed and the CP value is decreased by 2. Then, an amount of one step backward shift of the ribbon 110 and one line printing are executed.

Since the CP is 18, the process steps go to S300, where the shift direction change flag FS is set to 1 in order to change the next direction of the ribbon shift to forward. Then the process steps go to S230, S240 and then S130, where the ribbon 110 is shifted an amount of one step backward. One line printing is executed at the turn-down position of the upper end of the ribbon.

Figure 11:
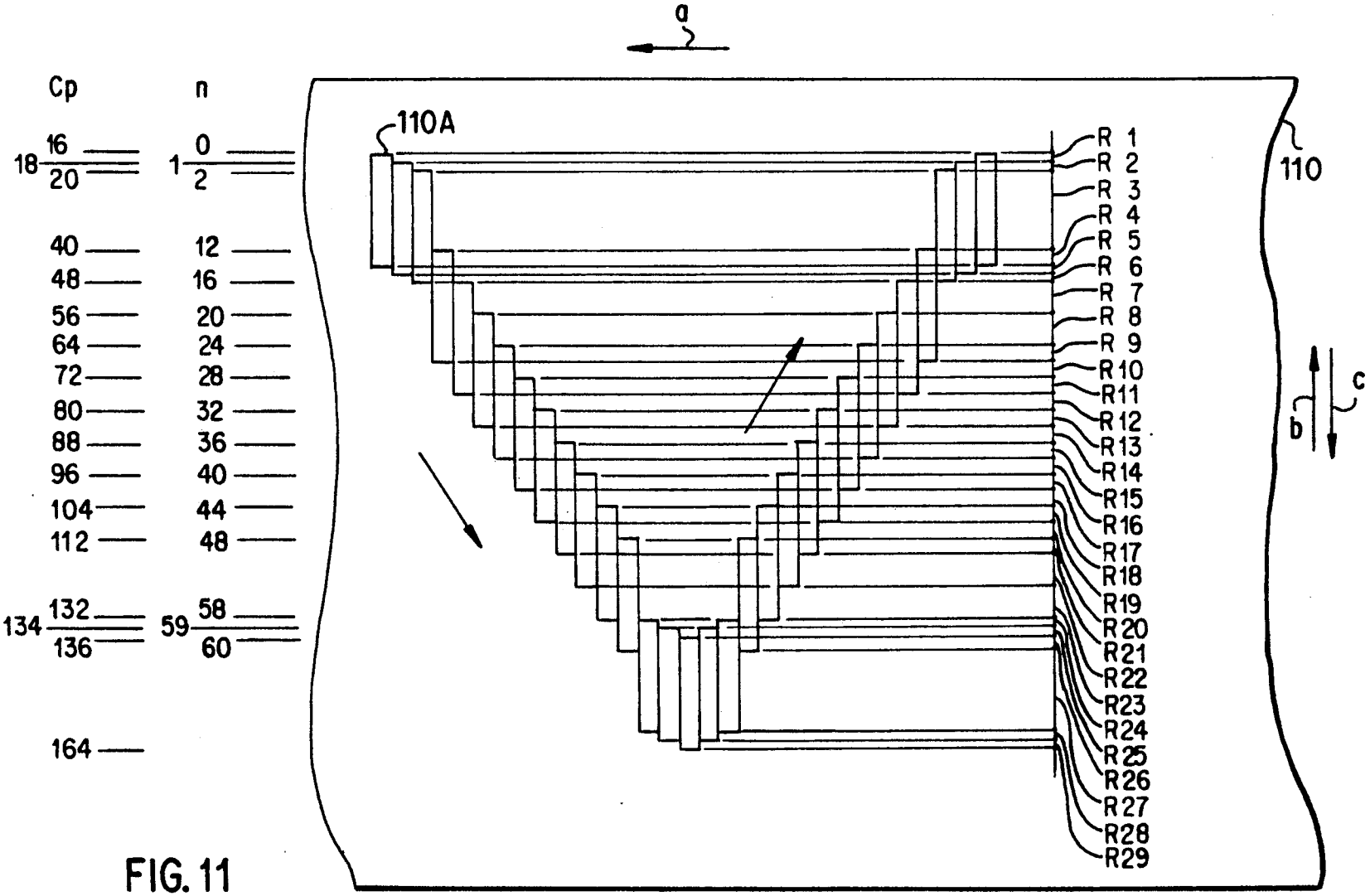
FIG. 11 is an explanation of operations in the second embodiment.

Next, the shift status of the printing position on the printing ribbon 110 is explained starting from the actuation of the printer with reference to FIG. 11. In the figure, the CP represents the value of the position counter and n the step position.

When the printing shift routine is executed, the printing ribbon 110 is shifted, as shown in FIG. 11, forward "b", backward "c" and in a printing direction "a" while the printing position 110A reciprocates across the width of the ribbon 110. The following table 1 shows each usage frequency of each printing region R1, R2, R3 through R29 during one reciprocation of the printing 110A on the printing ribbon 110 and each respective percentage occupying the area.

TABLE

| Usage frequency (times) | Printing regions | Percentage |
|---|---|---|
| 1 | R1, R29 | 2.70 |
| 3 | R2, R28 | 2.70 |
| 4 | R6, R7, R23, R24 | 13.51 |
| 5 | R3, R27 | 27.02 |
| 6 | R5, R8, R10, R12, R14, R16, R18, R20, R22, R25 | 29.74 |
| 7 | R4, R26 | 5.41 |
| 8 | R9, R11, R13, R15, R17, R19, R21 | 18.92 |

As shown in the above table, the usage frequency of R1, R2, R28 and R29 on both the ends of the ribbon 110 is 3 times or less and the percentage of R1, R2, R28 and R29 is only 5.4 in this embodiment. Accordingly, the area used substantially uniformly is broadened, thus improving the usage efficiency of the ribbon, making imperceptible nonuniform printing shades and maintaining better printing quality for a longer time.

Moreover, the usage frequency of R3, R27 on the upper end portion and the lower end portion within the specified region from the turning position on both the end portions of the ribbon is high, thus making uniform the ink that remains within the printing region, averting the leakage to the impact position by the printing wire and diminishing the non-uniform shade of characters printed.

Further, when the printing position is situated on the upper and lower adjacent regions to the upper and lower end regions at the central side of the ribbon 110, this embodiment is constituted to shift by the amount of ten steps, namely, an amount of less than fourteen steps corresponding to the height of the character which can be printed by all the printing wires of the printing head 101 and an amount of more than four steps in the central region of the ribbon 110.

This constitution enables a more uniform usage frequency, an improved usage efficiency of the ribbon, and a stabilized printing quality of the uniform printing shade.

This invention is not limited to the above embodiment but can be modified in various ways without departing from the scope and spirit of the invention. This invention is constituted such that the ribbon shift is executed corresponding to one line printing but can be constituted so as to do the shift each time when the ribbon 110 accommodated in the cassette 111 makes one round. Further, if another one-line printing is executed again at the turning portions on both the ends of the ribbon after executing one line printing and feeding the ribbon only in the printing direction, the usage frequency at both the ends of the ribbon increases, thus decreasing ink run.

What is claimed is:

1. A printer that prints under control of print data, comprising:

a print head for printing on a print medium according to the print data;

a print ribbon extending in the direction of the printing lines, where a width of the print ribbon is larger than the print head and the width of the print ribbon contains two side regions and a central region located between the two side regions;

a print-ribbon shift means for shifting the print ribbon;

a print-ribbon feed means for feeding the print ribbon across the print head in the direction of the printing lines; and a control means for controlling the print-ribbon shift means such that the ratio of a shift amount of the print ribbon to feed amount of the print ribbon is greater when the central region of the print ribbon is adjacent to the print head than when one of the two side regions is adjacent to the print head.

2. The printer of claim 1, wherein the control means sends shift signals to the print-ribbon shift means and sends feed signals to the print-ribbon feed means, the print-ribbon shift means shifts the print ribbon according to the shift signals, and the print-ribbon feed means feeds the print ribbon according to the feed signals.

3. The printer of claim 2, in which the print head prints a line of dots in the direction of the width of the print ribbon, and a given region of the print ribbon is adjacent to the print head when the center of the line of dots is within the given region.

4. The printer of claim 3, in which the print ribbon comprises a black zone and a red zone both running the length of the print ribbon, where the two side regions and the central region are contained in the black zone.

5. The printer of claim 4 in which the control means further sends color-shift signals to the print-ribbon shift means to cause the print-ribbon shift means selectively to shift the print ribbon such that the print head is adjacent to the red zone or the print head is adjacent to the black zone.

6. The printer of claim 5, in which the control means sends color-shift signals such that:

when the print head is adjacent to the black zone within a first predetermined range far from the red zone, the print-ribbon shift means shifts the print ribbon in two steps to move the print ribbon such that the print head is adjacent to the red zone;

when the print head is adjacent to the black zone within a second predetermined range near to the red zone, the print-ribbon shift means shifts the print ribbon in one step to move the print ribbon such that the print head is adjacent to the red zone; and when the print head is adjacent to the red zone, the print-ribbon shift means shifts the print ribbon in one step to a predetermined position such that the print head is adjacent to the black zone.

7. A printer that prints under control of print data, comprising:

a print head for printing on a print medium according to the print data;

a print-head moving means for moving the print head along printing lines of the print medium;

a print ribbon extending in the direction of the printing lines, where a width of the print ribbon is larger than the print head and the width of the print ribbon contains two side regions and a central region located between the two side regions;

a print-ribbon feed means for feeding the print ribbon across the print head in the direction of the printing lines according to feed signals;

a print-ribbon shift means for shifting the print ribbon in two directions across the print head according to shift and change direction signals;

a control means for sending feed signals to the print-ribbon feed means and shift signals and change direction signals to the print-ribbon shift means; wherein the control means sends one feed signal for each shift signal when the print head is adjacent to the central region; and the control means sends a plurality of consecutive feed signals, a change direction signal, and a shift signal when the print head is adjacent to one of the two side regions.

8. The printer of claim 7, in which the control means sends four feed signals, a change direction signal, and two shift signals when the print head is adjacent to one of the two side regions.

9. The printer of claim 7, in which the print ribbon comprises a black zone and a red zone both running the length of the print ribbon, where the two side regions and the central region are contained in the black zone.

10. The printer of claim 9 in which the control means further sends color-shift signals to the print-ribbon shift means to cause the print-ribbon shift means selectively to shift the print ribbon such that the print head is adjacent to the red zone or the print head is adjacent to the black zone.

11. The printer of claim 10, in which the control means sends color-shift signals such that:

when the print head is adjacent to the black zone within a first predetermined range far from the red zone, the print-ribbon shift means shifts the print ribbon in two steps to move the print ribbon such that the print head is adjacent to the red zone;

when the print head is adjacent to the black zone within a second predetermined range near to the red zone, the print-ribbon shift means shifts the print ribbon in one step to move the print ribbon such that the print head is adjacent to the red zone; and when the print head is adjacent to the red zone, the print-ribbon shift means shifts the print ribbon in one step to a predetermined position such that the print head is adjacent to the black zone.

12. A printer that prints under control of print data, comprising:

a print head for printing on a print medium according to the print data;

a print-head moving means for moving the print head along printing lines of the print medium;

a print ribbon extending in the direction of the printing lines, where a width of the print ribbon is larger than the print head and the width of the print ribbon contains two side regions and a central region located between the two side regions;

a print-ribbon feed means for feeding the print ribbon across the print head in the direction of the printing lines according to feed signals;

a print-ribbon shift means for shifting the print ribbon first and second shift distances in two directions across the print head according to first shift signals, second shift signals, and change direction signals, where the first shift distance is longer than the second shift distance;

a control means for sending feed signals to the print-ribbon feed means and first shift signals, second shift signals, and change direction signals to the printribbon shift means; wherein the control means sends one first shift signal for each feed signal when the print head is adjacent to the central region; and the control means sends one second shift signal for each feed signal and a change direction signal when the print head is adjacent to one of the two side regions.

13. The printer of claim 12, in which the control means sends four second shift signals and a change direction signal after the second shift signal when the print head is adjacent to one of the two side regions.

14. The printer of claim 13, in which the control means further sends a third signal, which moves the print head a greater distance than does the first signal, immediately before the four second shift signals.

15. The printer of claim 12, in which the print ribbon comprises a black zone and a red zone both running the length of the print ribbon, where the two side regions and the central region are contained in the black zone.

16. The printer of claim 15 in which the control means further sends color-shift signals to the print-ribbon shift means to cause the print-ribbon shift means selectively to shift the print ribbon such that the print head is adjacent to the red zone or the print head is adjacent to the black zone.

17. The printer of claim 16, in which the control means sends color-shift signals such that:

when the print head is adjacent to the black zone within a first predetermined range far from the red zone, the print-ribbon shift means shifts the print ribbon in two steps to move the print ribbon such that the print head is adjacent to the red zone;

when the print head is adjacent to the black zone within a second predetermined range near to the red zone, the print-ribbon shift means shifts the print ribbon in one step to move the print ribbon such that the print head is adjacent to the red zone; and when the print head is adjacent to the red zone, the print-ribbon shift means shifts the print ribbon in one step to a predetermined position such that the print head is adjacent to the black zone.

18. The printer of claim 17, in which print head is adjacent to the central region after the print-ribbon shift means shifts the print head to the predetermined position.

* * * * *